US006063449A

United States Patent [19]

Koskinen et al.

[11] Patent Number: 6,063,449

[45] **Date of Patent: *May 16, 2000**

[54] METHOD AND APPARATUS FOR COATING A MOVING PAPER OR CARDBOARD WEB

[75] Inventors: Jukka Koskinen, Järvenpää ; Erkki Kirveskari, Halkia; Vilho Nissinen, Numminen; Jorma Kinnunen, Helsinki; Seppo Luomi, Järvenpää, all of Finland

[73] Assignee: Valmet Corporation, Helsinki, Finland

[ * ] Notice: This patent is subject to a terminal disclaimer.

[21] Appl. No.: 09/051,164

[22] PCT Filed: Oct. 7, 1996

[86] PCT No.: PCT/FI96/00526

§ 371 Date: Jun. 2, 1998

§ 102(e) Date: Jun. 2, 1998

[87] PCT Pub. No.: WO97/13036

PCT Pub. Date: Apr. 10, 1997

[30] Foreign Application Priority Data

Oct. 5, 1995 [FI] Finland ..... 954745

[51] Int. Cl.[7] ..... B05B 13/02; B05D 1/02

[52] U.S. Cl. ..... 427/424; 427/421; 118/314; 118/315; 118/324

[58] Field of Search ..... 427/421, 326, 427/424; 118/314, 315, 324

[56] References Cited

U.S. PATENT DOCUMENTS

| | | | |
|---|---|---|---|
| 4,369,584 | 1/1983 | Daane | 34/12 |
| 4,944,960 | 7/1990 | Sundholm et al. | 427/27 |
| 5,115,972 | 5/1992 | Maier et al. | 239/8 |
| 5,316,800 | 5/1994 | Noakes et al. | 427/466 |
| 5,340,402 | 8/1994 | Beisswanger | 118/410 |
| 5,622,599 | 4/1997 | Sproule et al. | 162/186 |
| 5,650,200 | 7/1997 | Koskinen | 427/348 |
| 5,849,321 | 12/1998 | Linnonmaa | 427/421 |

FOREIGN PATENT DOCUMENTS

WO 94/11116 5/1994 WIPO .

*Primary Examiner*—Shrive Beck
*Assistant Examiner*—Jennifer Calcagni
*Attorney, Agent, or Firm*—Cohen, Pontani, Lieberman & Pavane

[57] ABSTRACT

A method and apparatus for coating a moving web of paper or paperboard. The web to be coated is passed to a coater station, wherein a coat layer is applied to at least one surface of the web by means of high-pressure spraying nozzles, whereby the pattern width covered by a single nozzle is essentially narrower than the cross-machine width of the web being coated. The nozzles are located in an enclosure and the excess coat mist formed in the process is removed by means of suction tubes, and advantageously, with the help of a falling film of coating mix flowing down the internal wall(s) of the enclosure.

21 Claims, 11 Drawing Sheets

METHOD AND APPARATUS FOR COATING A MOVING PAPER OR CARDBOARD WEB

FIELD OF THE INVENTION

The present invention is directed to a method and apparatus for coating a moving web of paper or paperboard in which an applicator or levelling apparatus applies a coat layer to the web without contacting the web.

BACKGROUND OF THE INVENTION

To improve the printability of paper, the paper may be coated with a coating formulation containing mineral pigment and binder components. Over the years, application and levelling of the coat have been carried out using a variety of apparatuses. Higher web speeds and increased demands on process efficiency and paper quality in combination constitute the stimulus driving the development of applicator equipment.

Initially, paper coating with a pigment-containing formulation was performed using coaters of the gate roll type, in which the coating mix was first metered with the help of furnish rolls to a set of transfer rolls, and therefrom further to the moving web of paper. However, the function of such a coater is impaired at web speeds exceeding 400 m/min. The nips of the rolls start to throw out splashes of the coating mix, and the coating process lacks the stability required to achieve an acceptable coat quality. Furthermore, well-behaved control of coat weight is difficult to achieve when using the above-described technique.

Particularly for surface sizing, sizing presses have been used in which the downward, running web is passed through a coat mix pond sealed by the rolls. Herein, a problem arises from the strong increase of moisture content in the web and difficult controllability of the correct amount of applied size.

In the kiss-coating technique, the coating mix is metered directly in a nip from the casting roll to the surface of the paper web. In the early days, and in paperboard coating even today, excess coat is doctored away with the help of an air knife. At web speeds above 500 m/min, however, the impact force of the air flow from the slot orifice of the air knife is insufficient for effective doctoring of the coat layer applied to the web surface.

An essential increase in coating speed was facilitated by the adoption of the doctor blade levelling technique for controlling the final coat weight. In the first generation of blade coaters, the web was arranged to run from above downward, and the coating mix was pumped into a pond formed in the recess between the backing roll and the blade. In fact, the same technique is still being used in two-sided coating.

The actual break-through of the blade coating technique occurred along with the adoption of the transfer coating method. Herein, the coat is applied directly to the web surface in the nip between a transfer roll and a backing roll. Excess coat is removed by means of a doctor blade extending aver the entire web width. This kind of coating technique makes it possible to increase the web speed to about 1300 m/min. At web speeds above this, splashing of the coat at the nip and the air film which is entrained in the nip along with the moving web, thereby causing skip marks on the coated web, make the use of this method extremely complex if not impossible. The higher the web speed, the fewer degrees of freedom will be available in the selection of coat mix components. Herein, the coating mix formulations must be selected under the constraints of web runnability, sometimes even compromising the quality of the end product.

Due to the poor runnability of transfer coaters, a short-dwell doctor blade coater was developed to provide an alternative technique for applying light coats to thin-caliper paper grades. In this type of coater, the web is guided past a slot orifice box which is formed by a short-dwell application chamber and the doctor blade and is adapted to operate against a backing roll. This method has been extremely popular in the art and facilitated effective on-machine coating. Also in this method, the maximum practicable web speed has turned out to be the limiting factor for further development. At web speeds above 1300 m/min, striping will appear at coat weights higher than 9 g/in$^2$ due to turbulence in the applicator flow chamber. In addition, an essential impairment of the cross-machine coat profile occurs with higher coat weights.

Improvements in the design of film transfer-type coaters typically used in surface sizing of paper have extended the use of these coaters to the application of pigment coats, too. Herein, the coating mix is first metered by means of an apparatus similar to a short-dwell coater onto a transfer roll, wherefrom the coat film is further transferred in a nip of two rolls to the surface of the paper web. This novel technique was initially introduced to surface sizing and later also to the application of a pigment coat at unconventionally high web speeds. However, problems are encountered in the form of coat mist and splashing occurring at the splitting point of the coat film when the web exits the film transfer nip. When applied at high web speeds, coats heavier than 10 g/m$^2$ suffer from an orange-peel texture and other low-quality surface properties incapable of fulfilling all the specifications that may be set on a finished end product.

The coat splashing and web skipping problems occurring an the application roll have generally been overcome by means of the nozzle application technique, which gives a wider latitude in the direction of higher web speeds. Additionally, better capabilities of applying heavy coat weights have been attained through more effective water drainage offered by the longer dwell time. Moreover, the coat forms a layer of higher solids content close to the base sheet surface that provides support to the doctor blade, whereby blade stability is improved and cross-machine profiles of improved evenness are attained.

When the nozzle-application step based on a doctor blade and a subsequent levelling step based on a scraper element are performed against the same backing element, a runnability complication in the form of creases and/or bags in the web generally occurs. This problem can be eliminated by implementing the application and levelling steps against separate backing elements. Due to the resultant increase of dwell time and paper moisture content, some difficulties will be encountered in the runnability of lightweight and high-moisture-absorbance paper grades.

The striping problem of short-dwell coaters has been alleviated with the dam blade construction known from the film transfer method of coating. However, all the above-described application methods are hampered by the mechanical contact and load imposed on the web by the coater. Particularly in blade coaters, paper production will easily be disrupted by defects in the base sheet. The paper mills have a strong drive to improve the efficiency of coater lines. Obviously, valuable production time will be lost due to web breaks. In conventional application techniques, the time to regain an acceptable quality after a web break takes an unduly long time.

For wet-on-wet coating, a blade coater is not necessarily the best possible alternative. In this coating method, to the same side of the web are applied at least two coat layers so that onto the first coat, while still moist, is directly applied the next coat layer without intermediate drying. Particularly in the application of a precoat, web defects like striping and unevenness are extremely detrimental. Therefore, a blade coater requires continuous control to keep the coat weight at its set value. Hence, a facility for measuring the precoat weight is mandatory in order to maintain controlled coat application. Such a coat weight measurement system operating between the successive application steps of coat layers is expensive and sometimes even impossible to arrange. Therefore, stable operation is required from wet-on-wet coaters so that the application and levelling of subsequent coat layers can be carried out without spoiling the already applied, still moist coat layers.

Attempts have been made to improve runnability in paper machines and coating stations with the help of supported web threading. Herein, an extremely smooth surface is required from the support wires or belts used in coaters. Furthermore, even the smallest irregularities of backing surfaces will cause coat marking not only particularly in blade coaters, but also in transfer coaters.

At higher web speeds, the rate of successfully performed flying splicing on the unwinder of off-machine coaters falls significantly. Splicing apparatuses required herein become expensive, and nevertheless problems will occur in exact timing of splicing. Therefore, future development of coaters must aim to provide an on-machine coater embodiment in which such problems associated with splicing and roll change cannot disturb the finishing treatment.

A blade performing the doctoring of the coat applied to the web tends to accumulate aggregations of dirt under the blade edge that cause striping of the coat. Due to such coating defects, large amounts of finished paper turn into scrap.

The rheological properties of the coating mix may cause web runnability problems due to the extremely strong fields of high shear rate acting on the coat mix in the blade tip region. Accordingly, the selection of possible coating mix formulations is often curtailed by the rheological constraints associated with the blade geometry.

In order to overcome the above-described drawbacks, paper coating should preferably be carried out using a noncontacting method. Through the use of a noncontacting method for coating the web, defects of the base sheet are prevented from disturbing the finishing treatment, complemented with a web threading system which is fully supported by wires and belts, it is possible to achieve a break-free, even a fully automated coating process. Herein, paper web defects can be identified by means of defect detectors and removed during intermediate winding in order to prevent them from interfering with further processing. Development of equipment for higher web speeds is no more hampered by load imposed on the web. The opacifying power of the applied coat becomes so good that the air knives, which today are the major factor limiting the maximum speed of paperboard coaters, can be replaced by the novel technique. Thus, the efficiency of coating lines and production throughput of coaters can be elevated to a remarkably high level.

In other prior art non-contacting coating methods such as that disclosed in PCT/US91/03830, the coating mix is fed into the nozzle via a separate duct, and atomization of coating mix is performed with the help of compressed air passed to the nozzle. However, tests have shown that insufficient atomization results from the use of a nozzle based on blast-diffusion by compressed air. Moreover, such a strong airflow causes excessive evaporative drying of the coating mix droplets before they can impinge on the sheet surface. Droplets of excessive size in the coat mist make the finished surface pitted and unsmoothly coated, which is manifested in the coat profile as craters and mounds.

U.S. Pat. No. 4,944,960 discusses an applicator apparatus in which the coating mix aerosol is formed in a separate chamber or apparatus using a gas-liquid nozzle or ultrasonic diffusor nozzle. The coat aerosol is passed into an applicator nozzle, wherein the aerosol is directed by means of separate gas injection to impinge on the sheet surface. The portion of the coating mix aerosol not adhering to the web is returned by suction back into the coating mix circulation. In such an apparatus, the coating mix droplets undergo evaporation before reaching the sheet surface, whereby their adherence to the sheet is impaired. Subsequently, when the paper is used in a printing shop, a large amount of dirt will build on the printing machine rolls and the coat will release dust in the trimming and folding equipment.

In the apparatus described in patent application No. PCT/F193/00453, the coat is applied using the above-described methods and then levelled using a doctor unit. This method represents a kind of direct application with the exception of its conventional doctor blade technique, the shortcomings of which were described above.

Noncontacting coater equipment are well-known and frequently used apparatuses in the art of painting and coating systems technology. High-pressure spraying equipment with suitable nozzles are commercially available for painting. However, the use of high-pressure spraying for applying coating mix to a moving web of paper or paper-board in the fashion described in detail later is a novel application of the noncontacting application technique.

In order to make it possible to spray a coating mix or material onto a surface to be coated, the fluid material must be dispersed into small droplets. This step is called atomization. The basic idea of atomization covers a variety of different uses ranging from painting to varied combustion installations, engines and apparatuses for mass and heat transfer such as gas scrubbers and evaporation towers. As a general term, atomization refers to conversion of fluid material into droplet form (that is, particles of round or similar form). The type of the spray is categorized according to the cross-sectional shape of the spray jet. Normally, a hollow or solid conical or fanned spray is used. Spray coverage is defined as the width of the spray pattern at a certain distance from the nozzle tip. The spray angle is the opening angle of the spray cone emitted by the nozzle.

Atomization nozzles fall into four different classes:

1) High-pressure nozzles (pressure atomizers)
2) Atomizers based on rotary centrifugal atomization (rotary atomizers)
3) Air-assist and air-blast nozzles (twin-fluid atomizers)
4) Other methods.

High pressure atomizers are characterized in that therein atomization occurs driven alone by the internal pressure of the fluid being atomized. No atomizing air is used. In practical tests, airless atomizing nozzles have been found superior to air-blast nozzles.

In pilot-scale tests of the present invention, the spraying technique was first adapted to the application step of the coating mix. Levelling of the applied coat was performed using conventional doctor blade techniques. However, this combination did not offer any benefit over prior-art nozzle application methods.

The following shortcomings were found in this method:

for the nozzle types used in the test, the viscosity of the coating mix was too high to permit sufficient atomization of the coating mix to apply a smooth coat;

coating mix droplets did not gain sufficient kinetic energy to adhere and spread sufficiently on the sheet surface; and pressure levels used in the fluid atomizing nozzles were insufficient for the atomization of the coating mix.

Coating mix used in the atomization application method must have sufficiently high kinetic energy to drive the coat droplets formed at the nozzle against the web sheet surface to flatten and adhere to the web surface. At higher speeds, the droplets must also be capable of penetrating the barrier formed by the air film travelling along with the moving sheet surface. These requirements cannot be fulfilled by means of an air-blast atomizing nozzle. This is because the blasting air-flow causes strong evaporation of the coat droplets, whereby the deposition and spreading of the coating mix droplets on the sheet surface is worsened. Hence, the achievable coat quality remains unsatisfactory.

SUMMARY OF THE INVENTION

It is an object of the present invention to provide a noncontacting method of coat application free from the shortcomings of the above-described techniques.

The goal of the present invention is achieved by means of performing the coat spraying step onto the sheet surface with the help of high-pressure nozzles.

In accordance with the present invention, coating is applied to a surface of the web by spraying the coating mix onto the web surface using high pressure spraying nozzles so that the spray pattern width covered by a single nozzle is essentially narrower than the cross-machine width of the web being coated.

The present invention offers significant benefits.

The present method of entirely noncontacting coat application, which is free from any need for coat doctoring, is capable of significantly improving the runnability of coating equipment. The method applies no strong forces loading the web, whereby coating may be carried out against a web running over a backing roll, belt or even unsupported. High-pressure airless spraying nozzles give an extremely smooth surface, which has a coat profile similar to that obtained by means of an air knife, however, with a smoother profile, in some cases even smoother than that of a doctored coat. Obviously, the smoothness of the coated web is affected by the base sheet profile, and therefore, the base sheet to be coated is advantageously run through a precalendering step prior to the application of the sprayed coat. In the method, the coat settles as a uniform layer of constant thickness on the base sheet surface, whereby a high opacifying power of the coat layer is attained. Hence, the method is particularly suited for coating only semibleached paperboard grades. The control of coat weight and profile is easy by way of altering the number of nozzles and coat pumping rate to each individual nozzle. On the basis of tests performed, it appears that the impact of the coat spray on the sheet does not cause strong migration of water from the coating mix into the base sheet. The method is extremely well suited for wet-on-wet coating, because the coat sprays emitted by the nozzles do not agitate the previously applied layer and the load imposed on the moist web is low.

The applicator apparatus according to the present invention has a simple and compact construction requiring minimal space permitting relatively free integration of the applicator as a unit of the coating line. If so desired, the coater unit of the present invention may be installed inside the paper machine. Because of the cost-efficient structure of the apparatus, multilayer coating at lower cost compared to the prior art becomes possible, whereby the overall coat thickness can be increased. By applying different coat layers, the paper quality can be controlled in a more cost-advantageous fashion as compared to the prior art and differently coated paper grades can lie made more flexibly in a single coating line.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

Figure 1:
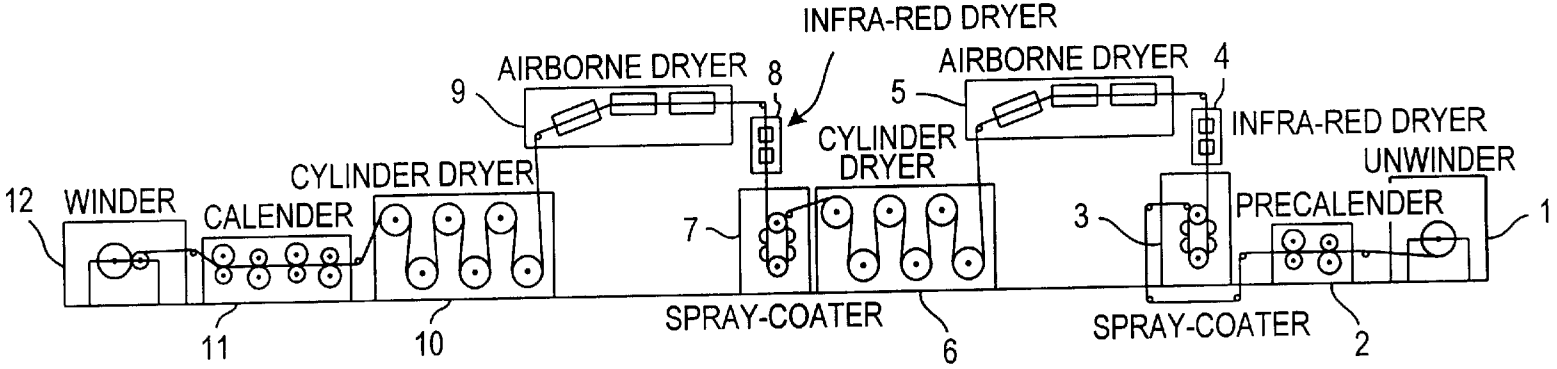
FIG. 1 shows a first coating line configuration implemented using an applicator apparatus according to the present invention.

According to the present invention, the coat is applied to the web by means of high-pressure airless spraying nozzles. The fluid is atomized in the nozzle heads by passing the pressurized liquid through a small-orifice nozzle. Thence, the core component of the spray-coater apparatus is the coat-atomizing nozzle. Test results indicate that high-pressure spraying nozzles of the airless type are generally to be preferred. The fluid may be pressurized in the range of 1–2000 bar. However, typical pressures vary in the range 100–300 bar. It has been found that pressures under 100 bar can, under no conditions, atomize the coating mix into droplets of sufficiently small size.

Typically, the spray-coater apparatus includes a nozzle assembly incorporating nozzles designed to emit fan-shaped sprays. The main axes of the fanned spray patterns of the nozzles are rotated by approx. 7–15° with respect to the cross-machine main axis of the nozzle set, whereby a relatively smooth coat profile results. The nozzle assembly is also characterized by an adjustment facility of the inter-nozzle distance and the distance of the entire nozzle assembly from the base sheet. The simplest design of the nozzle adjustment is such that it offers a simultaneous adjustment for all the nozzles of the system and provides as identical conditions as possible for all the nozzles. A separate adjustment for each nozzle gives certain latitude for the coat profile control over the cross-machine width of the nozzle spray pattern. Additionally, individual control of the nozzles could be used to some extent for compensation of orifice wear in the nozzles.

On the basis of tests performed, it has been found that the effective practicable spray pattern width achievable by means of a single nozzle is about 10 to 30 cm. This means that from 10 to 3 nozzles, respectively, are required per linear meter of web width. As it is plausible that a uniform coat quality cannot be attained by means of a single linear array extending over the entire web width, the spray-coater apparatus must be constructed using a plurality of linear nozzle arrays.

Formation of coat mist is one of the problems of the spray-coating method needing an effective solution. Elimination of coat mist formation can be categorized into four tasks: 1) the conditions of coating mix spraying are made such that the deposition of sprayed particles on the web occurs as unobstructed as possible, which in practice means removal of the air film travelling along with the surface of the moving web; 2) such nozzle designs are selected that produce droplets of as uniform size as possible, whereby the number of droplets of small size and kinetic energy is minimized; 3) the adhesion of the coat droplets to the web is maximized by all means, whereby such operating parameters as the electrostatic charging of the droplets, coating mix formulations and appropriate impact force of the fluid droplets on the web must be evaluated; and 4) suitable mechanical mist collector systems are used.

The spraying-nozzle unit must be located so that it can be sealed sufficiently tightly against a suitable backing surface. Such surfaces are offered at least by a web-supporting roll, belt, felt or wire. In this context, the term sealing refers to air-tight sealing of the peripheral areas of the applicator unit and of the edge areas of the web as well as controlled travel of the web at the ingoing and outgoing ports of the spray-coater. Such sealing is extremely crucial for proper collection of excess coat mist.

Spray-coating requires efficient removal of the air film travelling along with the web. The air film forms a barrier to the deposition of the sprayed particles on the web. As the removal of the air film also helps to reduce the formation of coat mist, the air film should be removed as effectively as possible and as close as possible to the ingoing port of the spray-coater unit. The removal of the air film can be accomplished by means of an arrangement operated in a doctor blade fashion, or alternatively, by adapting an air knife to blow against the web travel direction. By contrast, removal of the air film from the web surface inside the spray-coater unit may become a complicated task, because the coat mist tends to deposit on any surface inside the spray-coater unit.

Doctoring-away of the air film is an important step to be carried out just before the ingoing side of the spray- coating assembly. Such a doctoring of the air film can be implemented by means of, e.g., counterblowing based on air injection from an air knife reverse to the web travel direction. Also various doctor blade arrangements are suitable for the removal of the air film. The optimum location for such an air-layer-doctoring accessory is in the immediate vicinity of the spray-coater ingoing side. While the accessory elements may also be located inside the enclosure of the spray-coater unit, such a placement necessitates additional clean-keeping arrangements.

The coating mix must be furnished into the coating mix machine tank of the coater separately for each coating run with a specific formulation suited for spray-coating. The replenishment of fresh coating mix into the machine tank can be arranged to occur continuously or batch-wise. An essential requirement herein is that the coating mix must have a homogeneous composition with suitable physical properties. The constituents of the desirable coating mix formulation are determined separately for each base sheet type and grade. The viscosity and solids content of the coating mix are adjusted to be compatible with the spray-coating method. Generally, coating mix formulations optimized for spray-coating have a low solids content and viscosity as compared to coating mixes used with a doctor blade coater.

In the use of a spray-coater unit, at least three different operating modes may be categorized: 1) run mode, 2) wash mode, and 3) nozzle replacement mode, all of which can be arranged to occur without causing interruption in the actual function of the coater unit.

The spray-coater unit must be provided with a sufficiently rigid body, which can be sealed reasonably tightly against the backing surface supporting the web, whereby the coater unit body is arranged to include fixtures for mounting the spray-coating nozzles or nozzle arrays. The entire unit must also be attached by its body to an external support. The coater unit body is designed so that the different operating modes related to run, wash or replacement can be easily carried out.

The attachment of nozzles to the coater unit body can be implemented in a plurality of different fashions. A basic arrangement is the assembly of the nozzles into linear nozzle arrays extending over the cross-machine width of the web, or alternatively, attaching each nozzle separately to the body of the spray-coater unit. The linear array arrangement offers such benefits as easier robotic handling in automated removal of an entire linear array with the nozzles from the spray-coater unit for servicing and other operations. Furthermore, a linear array of nozzles is easier to provide with a common coating mix infeed channel having a single inlet port.

Depending on the operating principle of the coat mist collection system, the interior of the spray-coater unit can be provided with jet flow deflectors to improve the aerodynamics of the coater unit to perform successful application of the coat to the paper web, and on the other hand, to collect excess coat mist away from the coater unit interior with maximum efficiency.

The internal aerodynamic flow patterns of the coater unit can be controlled at least by means of the following elements: deflectors, steam tubes, air injection, water-moistening and sweating on surfaces (condensation).

The feed of coating mix to the nozzles must be compatible with the nozzle technology used. High-pressure airless nozzles are more demanding than low-pressure spray nozzles with the regard to the feed system.

An essential task, however, is presented by the need for some degree of independent control of the nozzles or nozzle arrays. In practice, this requires the infeed line to be equipped with a sufficient number of control valves. It is necessary to provide means for cutting off the coating mix feed to selected nozzles or nozzle arrays for the duration of servicing or replacement of the nozzles/nozzle arrays without causing disturbance to the operation of the other nozzles, linear nozzle arrays or spray-coater units. In the design of the coater unit, the control result can be affected by following factors: nozzle type, including ultrasonic and electrostatic techniques; application technique, together with control of nozzle distances and spray angles; and control of coat mist formation.

In its simplest embodiment, the spray-coater unit comprises a linear nozzle array placed at a suitable distance from the web and having a desired spray geometry of the spraying nozzles. Using this kind of an applicator apparatus, the coating mix spray is impinged on the web so as to apply an even coat layer extending over the entire cross-machine width of the web. When the spray-coater unit is used for coat profile control, the spraying nozzle assembly need not necessarily apply a coat layer for the full width of the web, but rather, the coat profile control can be achieved by local application as desired. Besides the nozzles, a full-function spray-coater unit must include a coat mist collection system capable of recovering and/or separating the coat mist formed as an excess of the coating process. Different implementations of coat mist collection systems are described below.

For achieving a high quality for the paper web coated on the spray-coater unit, the most important step is the spraying of the coat onto the paper web surface. Herein, the nozzle technology used forms the principal design factor which alone determines the coat quality achievable by the present method. In various tests, high-pressure airless nozzles (operated at pressures above 100 bar) have been found to provide optimal performance in spray-coating. Single nozzles of this type can be assembled into a linear array of nozzles, extending over the entire cross-machine width of the web.

A facility must be provided for the collection of the coat mist formed in the spray-coating process and its separation from the air. Successful collection of coat mist requires that the spraying nozzles are located in an enclosed space separated from the environment. The volume of the sealed space can be varied widely. In its smallest form, a separate closed space may be designed about each nozzle. In its largest form, e.g., an entire coater unit can be enclosed by a kind of hood. Also the enclosure of the entire coating line under a hood would be a feasible arrangement.

Plausibly, the optimal size of the coat mist collection system is such that it encloses a number of linear nozzle arrays. In the following, the term spray-coater unit is used to denote an applicator apparatus comprising at least the nozzles/nozzle arrays and a coat mist collection system with its operating means. The connection of the coater unit to the other parts of the coating line is not crucial, and thence, the location of the coater unit along the coating line can be varied.

In the simplest arrangement of coat mist collection, only vacuum suction is used for the removal of the coat mist hovering in the spray-coater unit. A problem in the design of this system is how to find the proper rate of air removal and select the optimal suction points so that the coating process itself will not be affected. As the function of this type of coat mist vacuum suction system is gravity-independent, the designer can freely align it in any physical position. In this technique, the actual separation of the coat mist is performed outside the spray-coater unit. The placement and size of the vacuum ducts can be varied, and internal air flow pattern of the coater unit may be optimized by selecting a suitable alignment, size and suction rate of the vacuum ducts.

In another embodiment of the coat mist collection system, a falling flow of coat or other liquid down the internal walls of the spray-coater unit enclosure is used for trapping the coat mist. Here, various devices can be employed to guide the coat mist hovering in the coater unit to make contact with the downward falling film of coat or liquid, whereby the coat mist aerosol particles are adhered to the falling film. This arrangement requires continuous pumping to both establish and remove the falling film of coat or liquid. The separation of the coat mist occurs here already inside the coater unit, instead of taking place outside the unit as is the case in the vacuum suction technique described above. However, a spray-coater unit equipped with the falling-film coat mist separation system cannot be located freely in different positions, because gravity-assistance is required to establish the falling film. Thus, the spray-coater body design can be varied to implement the most flexible arrangement of the coat mist collection system.

The two basic variants comprise the horizontally operating suction-based coat mist collection system and the vertically aligned tailing-film system.

The two basic techniques described above can be combined. This offers the maximal efficiency of coat mist removal. Additionally, the suction flow pattern can be arranged to force the random flow of hovering particles into an efficient contact with the falling film of coat/liquid.

In the following, two examples are given of coating line arrangements which use spray-coater units according to the present invention for coat application. The spray-coater systems themselves are described in a co-pending application based on the Finnish Patent Application 954,745.

Shown in FIG. 1 is a simple off-machine coating line adapted for single-layer, two-sided, coating of paper web. The first unit of the line is an unwinder 1, after which the web is taken to a precalender 2 comprised of, e.g., a nip of two soft rolls and one hard roll. Next after the precalender 2 is a spray-coater unit 3 in which e. desired coat layer is applied to the first side of the web. The actual coater unit comprises a belt-backed coater in which the coat is applied in two steps to the web supported by the belt. Such a coater unit is capable of applying a heavy coat in a single pass. subsequent to the coating step, the web is threaded to an infra-red dryer 4, followed by drying on an airborne dryer 5 and finally on a cylinder dryer 6. immediately after drying, the dried web is passed to a second spray-coater unit 7, followed by another sequence of the above-described equipment comprising drying on an infra-red dryer a, airborne dryer 9 and cylinder dryer 10. Subsequent to drying, the paper web is recalendered on a machine calender 11 comprising four nips and rewound into rolls on a winder 12. The coating line of FIG. 2 differs from the above-described system in that the winder 12 is immediately after the second coater and dryer section. The coating line is complemented with different calenders such as a soft-nip calender 13 and a supercalender 14.

Figure 2:
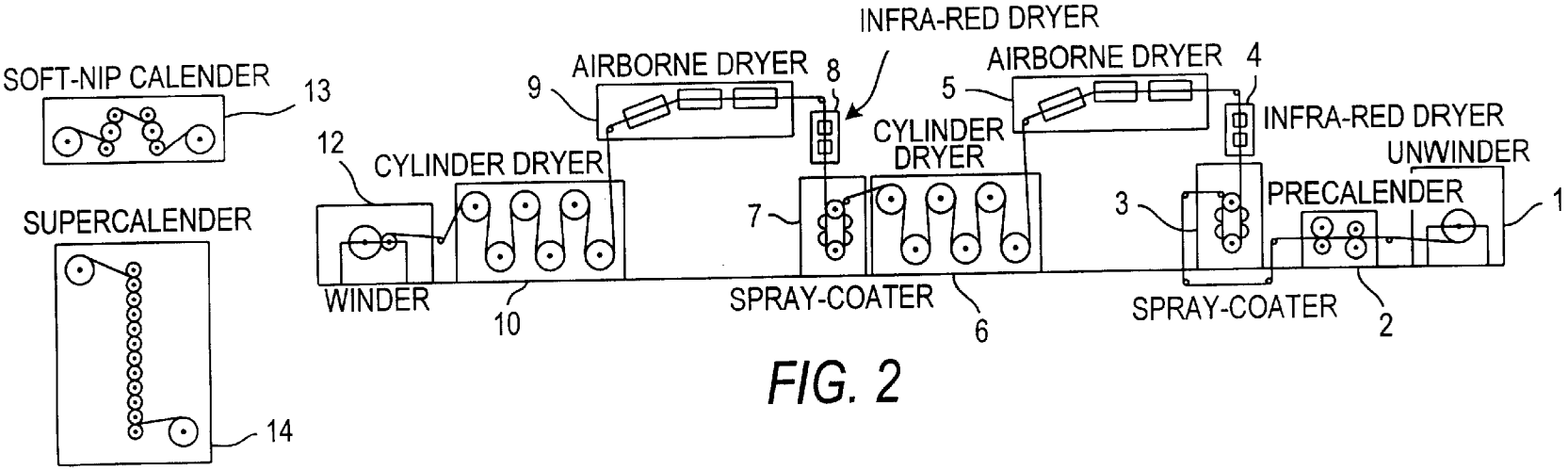
FIG. 2 shows a second coating line configuration implemented using an applicator apparatus according to the present invention.

One of the benefits of the coating lines shown in FIGS. 1 and 2 is their simple structure which, nevertheless, with the help of pre- and postcalendering is capable of providing a very smooth coat combined with the extremely good opacifying power which is characteristic of spray-coating. Additionally, the equipment of FIG. 2 can be readily modified for making paper grades of different finishes by varying the coating mix formulation and the calendering.

Figure 3:
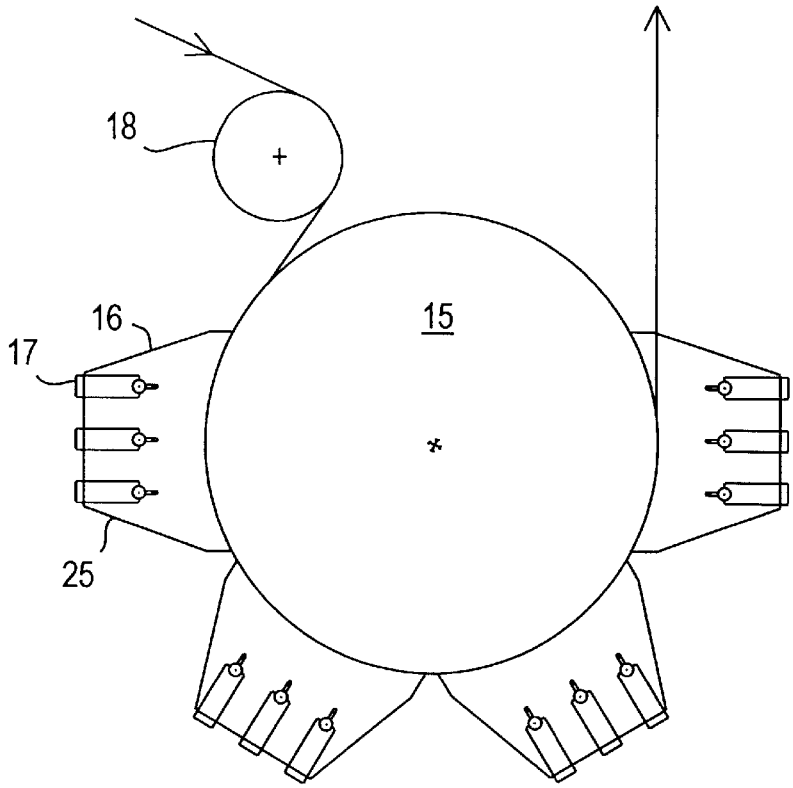
FIG. 3 shows an applicator apparatus according to the present invention.
Figure 4:
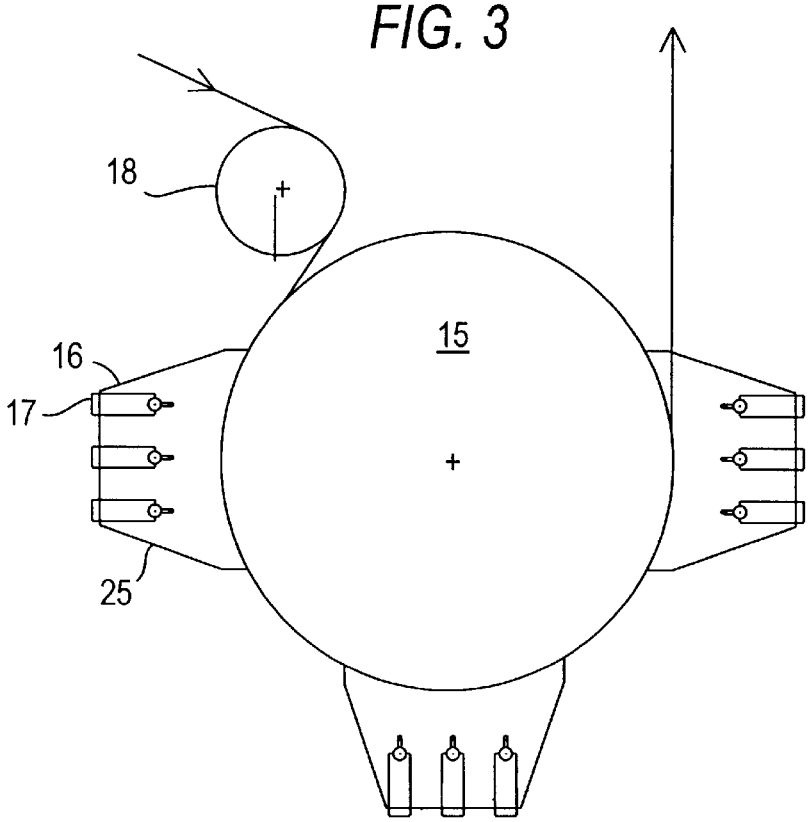
FIG. 4 shows another applicator apparatus according to the present invention.

In FIGS. 3 and 4 are shown two embodiments of the spray-coater apparatus. The apparatus of FIG. 3 comprises a backing roll 15, a guide roll 18 passing the web to the backing roll 15 and four applicator units 16 each including three parallel linear nozzle arrays 17. The linear nozzle arrays may be replaced by a nozzle assembly having the nozzles in a layout different from that of linear arrays, arranged so that the coverage of the nozzles is equivalent to that of at least 1 or 2 linear nozzle arrays. Thus, this coating method is capable of applying the coat in four steps performed in a single coater unit. The nozzle arrays 17 are located so staggered that the spray jets of one nozzle array 17 are always aligned at the internozzle spaces of the preceding nozzle array. The nozzle arrays 17 are enclosed in an enclosure 25 which borders the application area against the web. The coater shown in FIG. 4 has three applicator units. As is evident from the diagrams, the applicator units have an extremely simple construction permitting them to be installed in a very small space, whereby a single backing roll 15, for instance, can be provided with 1 to 4 adjacent applicator units 16, or even more by making the roll diameter larger. Due to their compact structure and small space requirement, the applicator units can be placed almost anywhere along a coating line, even inside a paper machine, whereby this type of coater makes it possible to implement coating lines of almost any configuration. An applicator unit equipped with three nozzle arrays 17 can provide a relatively smooth coat, and when desired, the number applicator units can be increased to make smoother coats and higher overall coat thicknesses.

Figure 5:
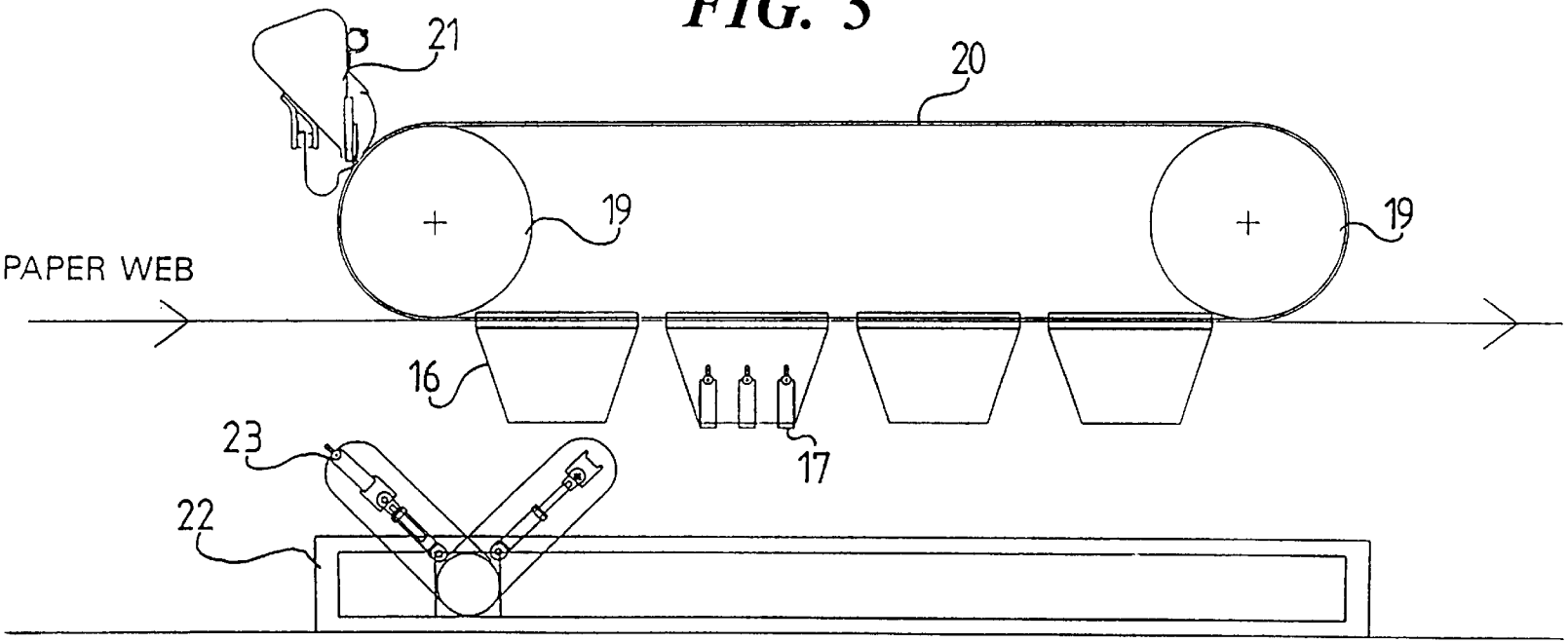
FIG. 5 shows a third applicator apparatus according to the present invention.

FIG. 5 shows a belt-backed coater unit. This unit includes two belt-guiding rolls 19, over which a support belt 20 running parallel with the web is passed. The applicator units 16 arc arranged to rest tightly sealed against the support belt 20, and the web is arranged to pass in front of the applicator 16 backed by the support belt 20. A scraper 21 is adapted to work in cooperation with the other backing roll 19 for keeping the belt 20 clean. With the help of such a belt-supported applicator device, a substantially great number of the applicator units 16 can be adapted into a single coater unit if so desired. The most significant benefit of the apparatus shown in FIG. 5, which has the applicator 16 placed in a succession over the linear support belt 20, 2.5 that the web can be passed to the coater unit directly without changing its direction. If drying of the web is implemented using noncontacting dryers, such as infra-red or airborne dryers, this type of a coater unit makes it possible to configure the entire coating line so that the web to be coated passes straight through the entire length of the coater installation. Because the spraying nozzles must be changed at certain intervals due to wear and dirt accumulation, the coater unit is provided with a robotic nozzle changer 22 for automatic replacement of the nozzles 23.

Figure 6:
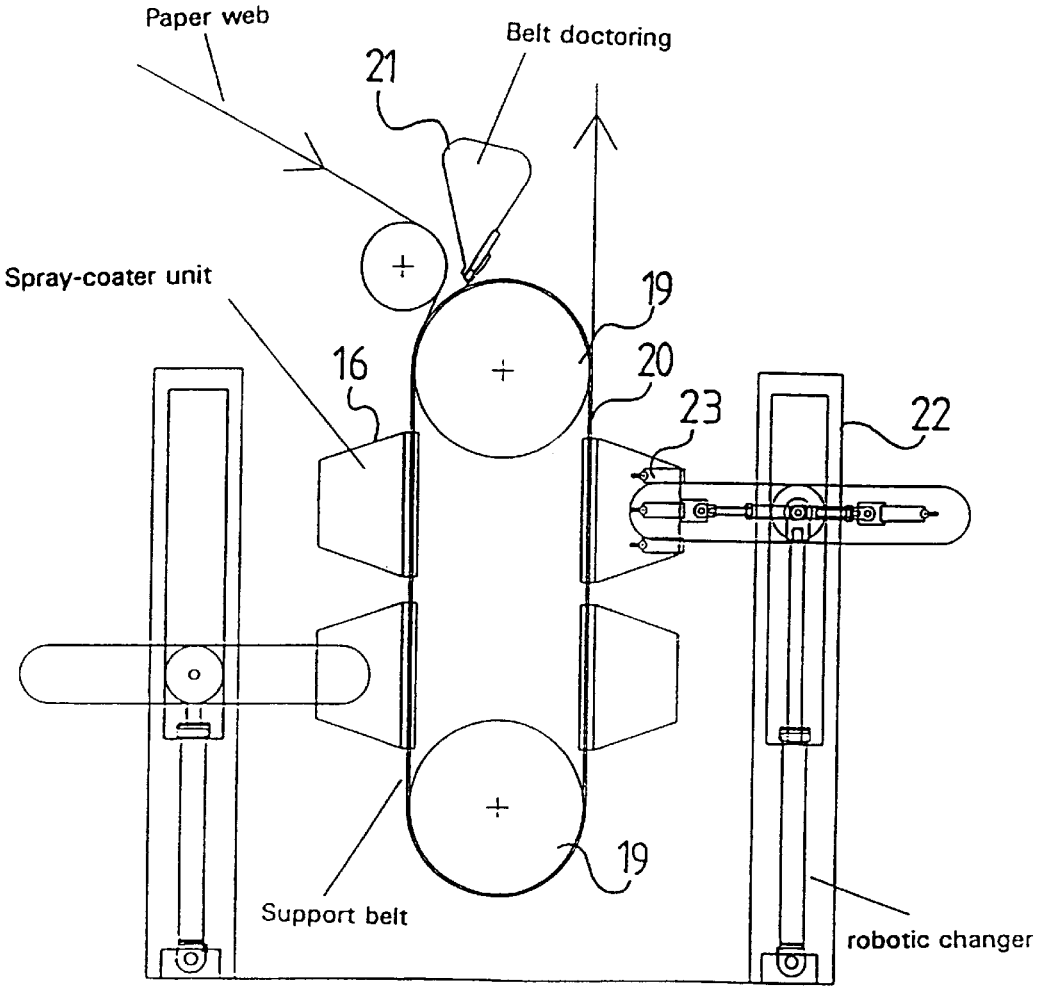
FIG. 6 shows a fourth applicator apparatus according to the present invention.

In FIG. 6 is shown a belt-supported applicator unit having the web adapted to pass backed by a support belt 20 over a belt-guiding roll 19. To both sides of the endless belt are placed two applicator units 16 and the robotic nozzle changers 22 of the nozzles 23. Such a coater unit is extremely flexible in use. For instance, it is possible to have one of the applicator units 16 continuously set off-duty due to nozzle change or cleaning, or alternatively, a schedule can be drawn so that at any one of the applicator units on one side of the support belt can withdrawn off-duty due to servicing. Also herein, the belt 20 is cleaned by means of a scraper 21.

Figure 8:
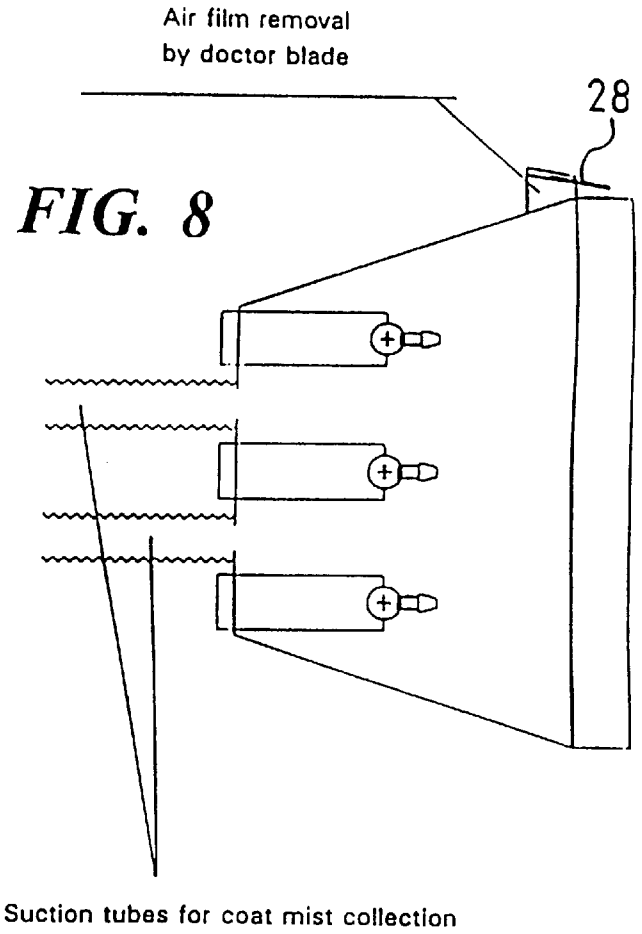
FIG. 8 shows a sixth applicator apparatus according to the present invention.
Figure 7:
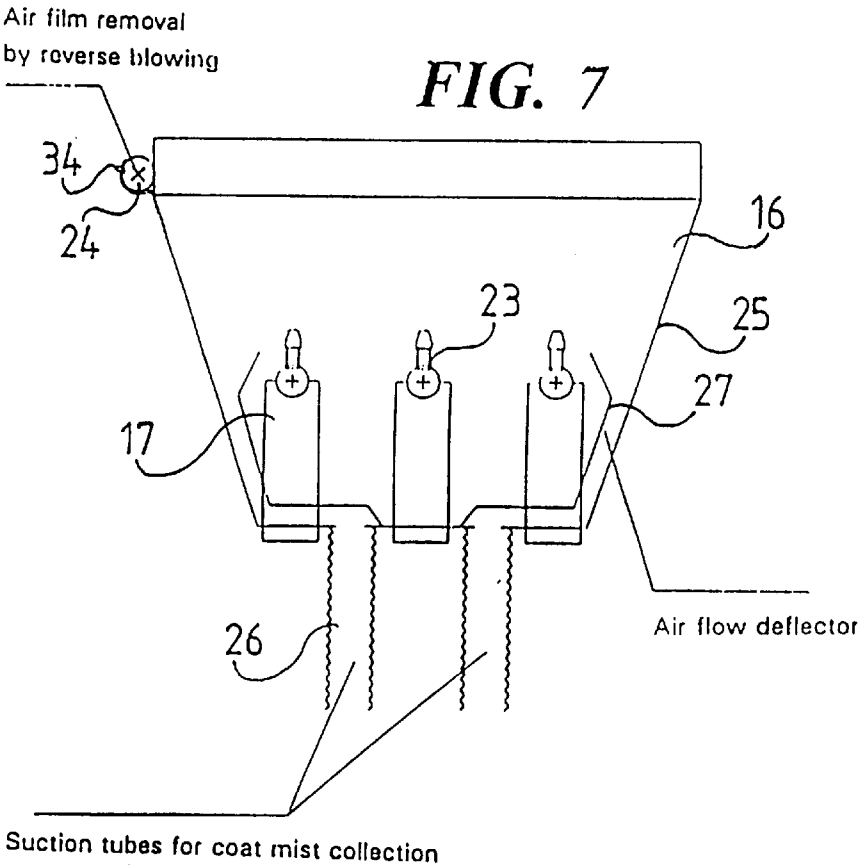
FIG. 7 shows a fifth applicator apparatus according to the present invention.

In FIG. 7 is shown an applicator unit 16 of the above-described type including a reverse-blowing air-knife assembly 24 for removal of the air film travelling along the web. The reverse-blowing air-knife 24 comprises an air tube placed at the incoming edge of the applicator unit enclosure 25 and having a slot orifice 34 for blowing an air jet reverse to the travel direction of the web. Further, the applicator unit incorporates a coat mist collection system comprising vacuum ducts 26 for removal of hovering coating mix aerosol from the applicator unit enclosure 25. close to the outermost nozzle arrays 17, at a distance from the inner walls of the enclosure 25, are air-flow deflectors 27 therefor which form, with the help of the flow induced by the suction of the vacuum ducts 26, an air flow along the inner walls of the enclosure 25 sufficient to remove from the enclosure 25 the coat mist that has escaped from the main spray emitted by the nozzles 23 without disturbing the spray pattern of the nozzles 23. In the apparatus shown in FIG. 8, the removal of the air film from the web surface is achieved by means of a mechanical scraper 28, while the vacuum ducts 26 for coat mist removal are adapted between the nozzle arrays. This arrangement is suitable for use at lower web speeds, wherein the amount of air film travelling along the web and the effect of the excess coat mist formed from the spray have a lesser effect.

Figure 9:
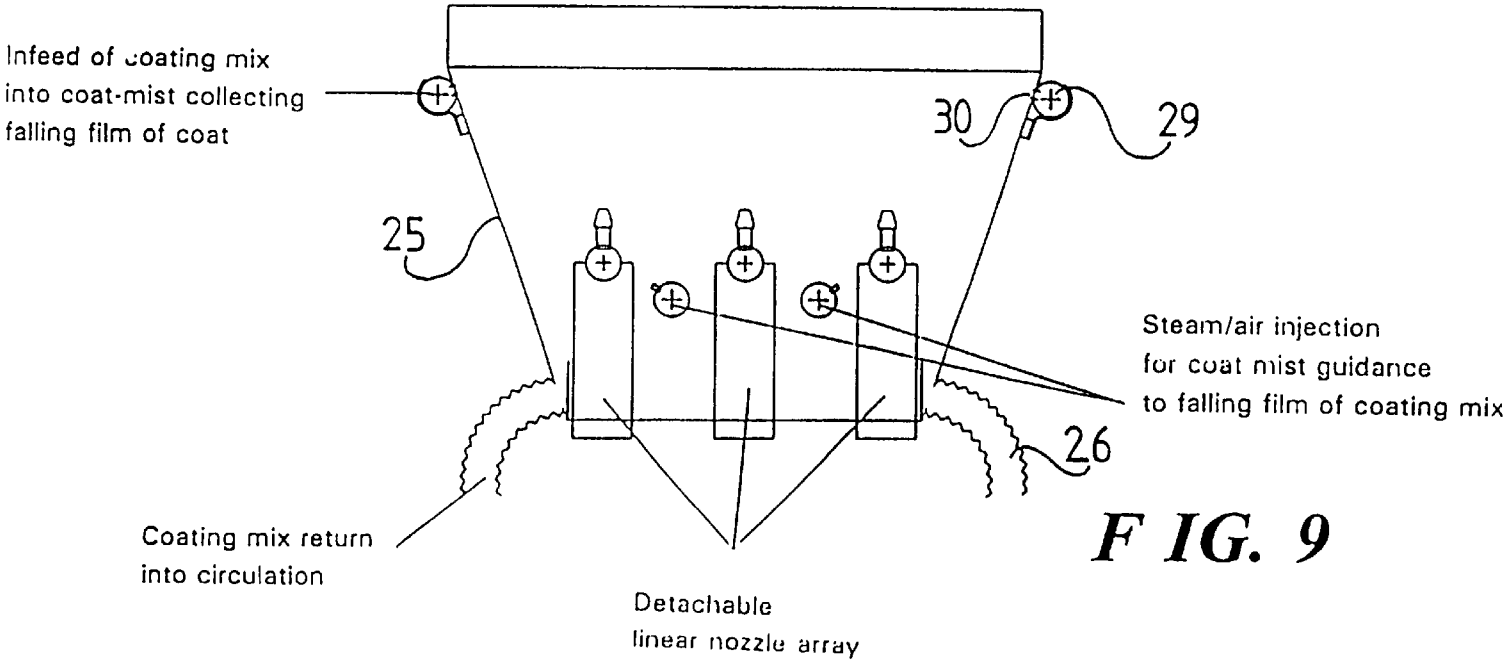
FIG. 9 shows a seventh applicator apparatus according to the present invention.

In FIG. 9 is shown another method of coat mist collection. Therein, to the sides of the applicator unit enclosure, close to the ingoing and outgoing points of the web, are placed coating mix infeed tubes 29 having slot orifice openings 30 for feeding coating mix onto the internal side walls of the enclosure 25. The suction ducts 26 for removal of collected coat mist are located at the lower corners of the side walls. In this arrangement, the liquid film falling down the side walls captures the coating mix aerosol particles hovering in the enclosure 25 and conveys the collected coat mist directly into the suction tubes 26.

Figure 10:
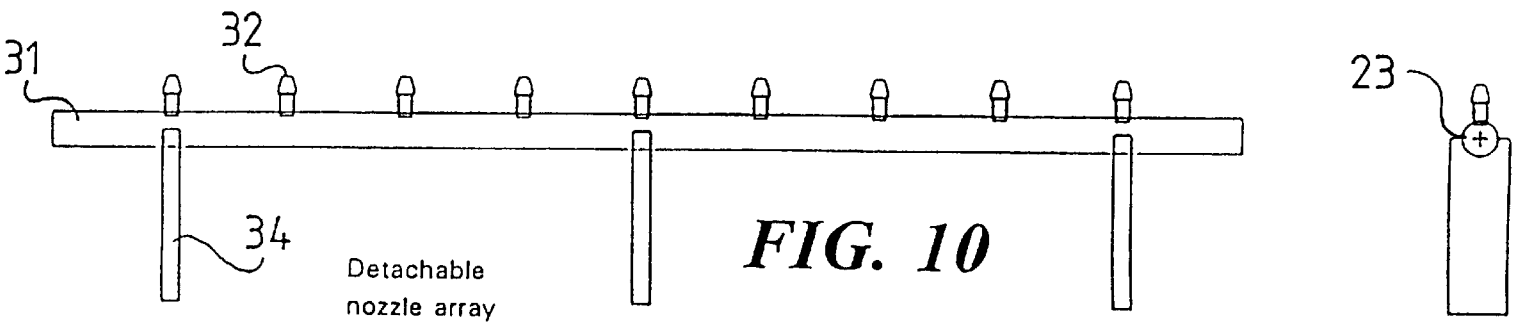
FIG. 10 shows a linear nozzle array suitable for use in applicator apparatus according to the present invention.

In FIG. 10 is shown a detachable linear nozzle array which can be employed instead of individually detachable nozzles 32. The nozzle array comprises a manifold tube 31, along which the coating mix is fed to nozzles attached to the manifold tube 31, and fixtures 34 for connecting the nozzle array to the applicator unit 16. Thus, it will be easy to change the entire nozzle array as an integral entity.

Figure 11:
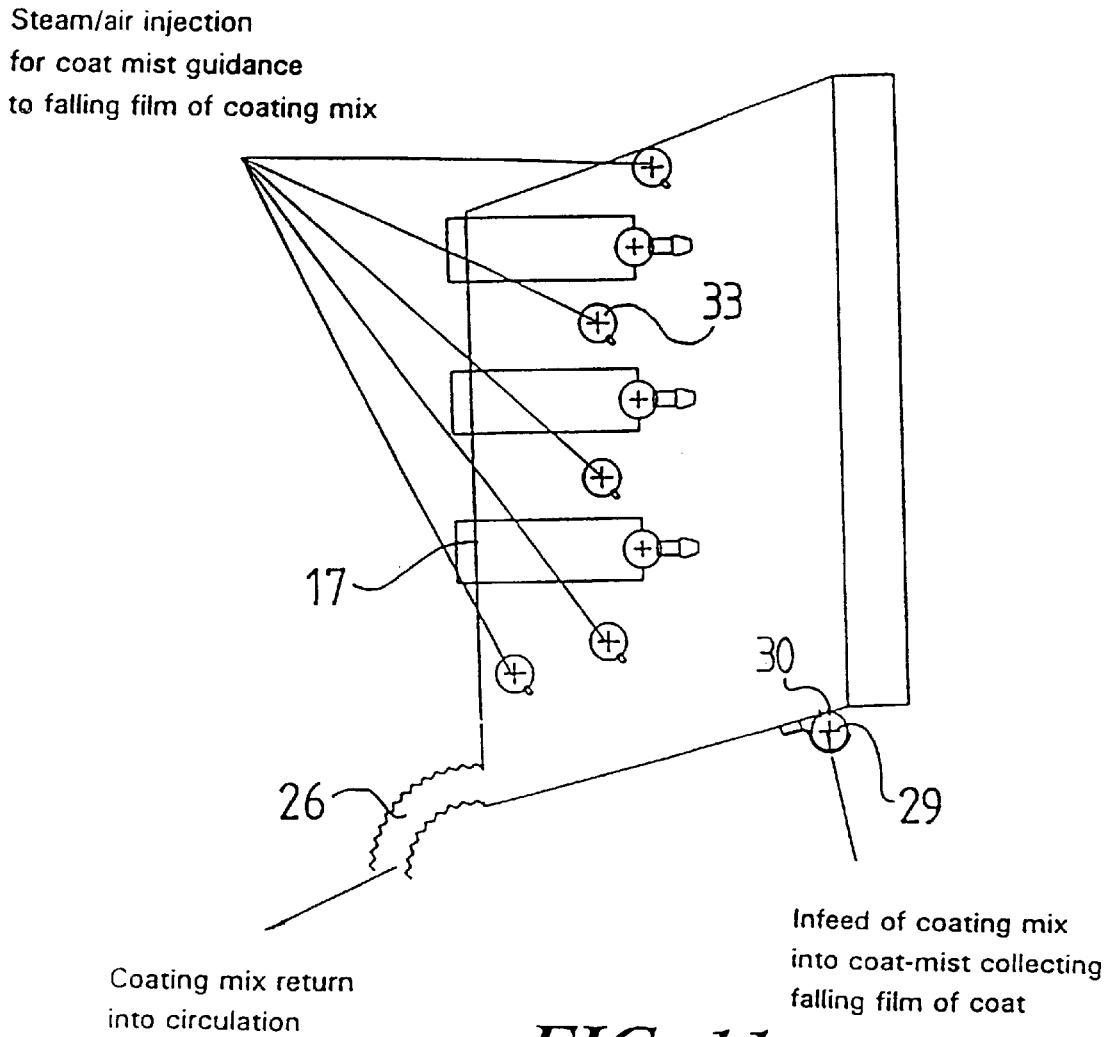
FIG. 11 shows an eighth applicator apparatus according to the present invention.

In FIG. 11 is shown an applicator unit suitable for mounting in a vertical position. Such an applicator can be used, e.g., in belt-backed coater equipment having the belt running vertically. In the enclosure of this applicator unit, the side wall lower edge facing the web is equipped with a coating mix infeed tube 29 serving to the feed coating mix along the side wall. The suction tube 26 for the removal of the collected coating mix is located at the lower corner edge of the same side wall. The coating mix aerosol hovering in the enclosure is directed to impinge onto the coating mix film falling down the interior side wall of the enclosure with the help of blow tubes 33 from which in the area remaining between the nozzle arrays 17 air or steam is injected toward the falling film of coating mix that captures the aerosol particles of hovering coating mist.

Figure 12:
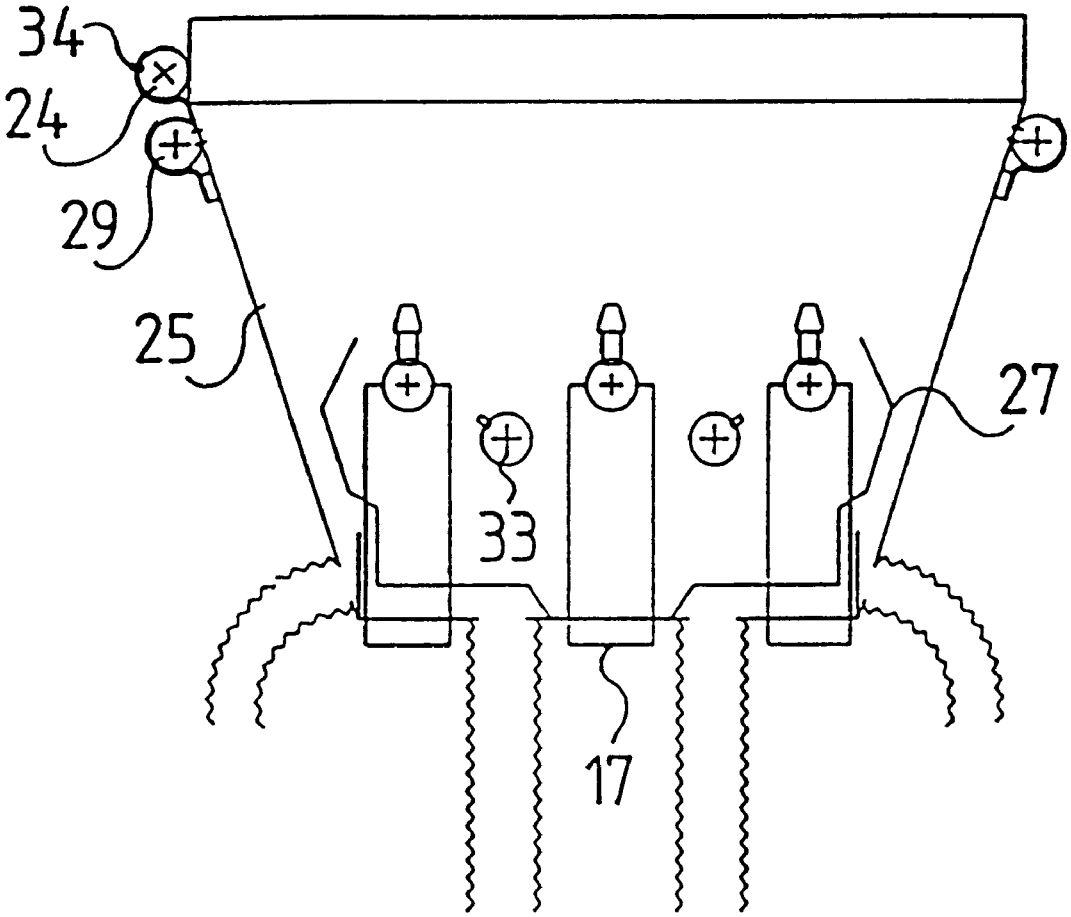
FIG. 12 shows a ninth applicator apparatus according to the present invention.

In FIG. 12 is shown an applicator unit which is equipped with a reverse-blowing air knife assembly 24 adapted therein for the purpose of removing the air film travelling on the web surface and additionally has coating mix infeed tubes 29 adapted to the interior side walls of the enclosure 25 for forming a falling film of coating mix that captures the hovering coat mist. Additionally, the enclosure houses tubes 33 adapted between the nozzle arrays 17 for injection of air or steam and further includes air flow deflectors 27 serving to guide the flow of the hovering coat mist toward the interior side walls of the enclosure 25.

Figure 13:
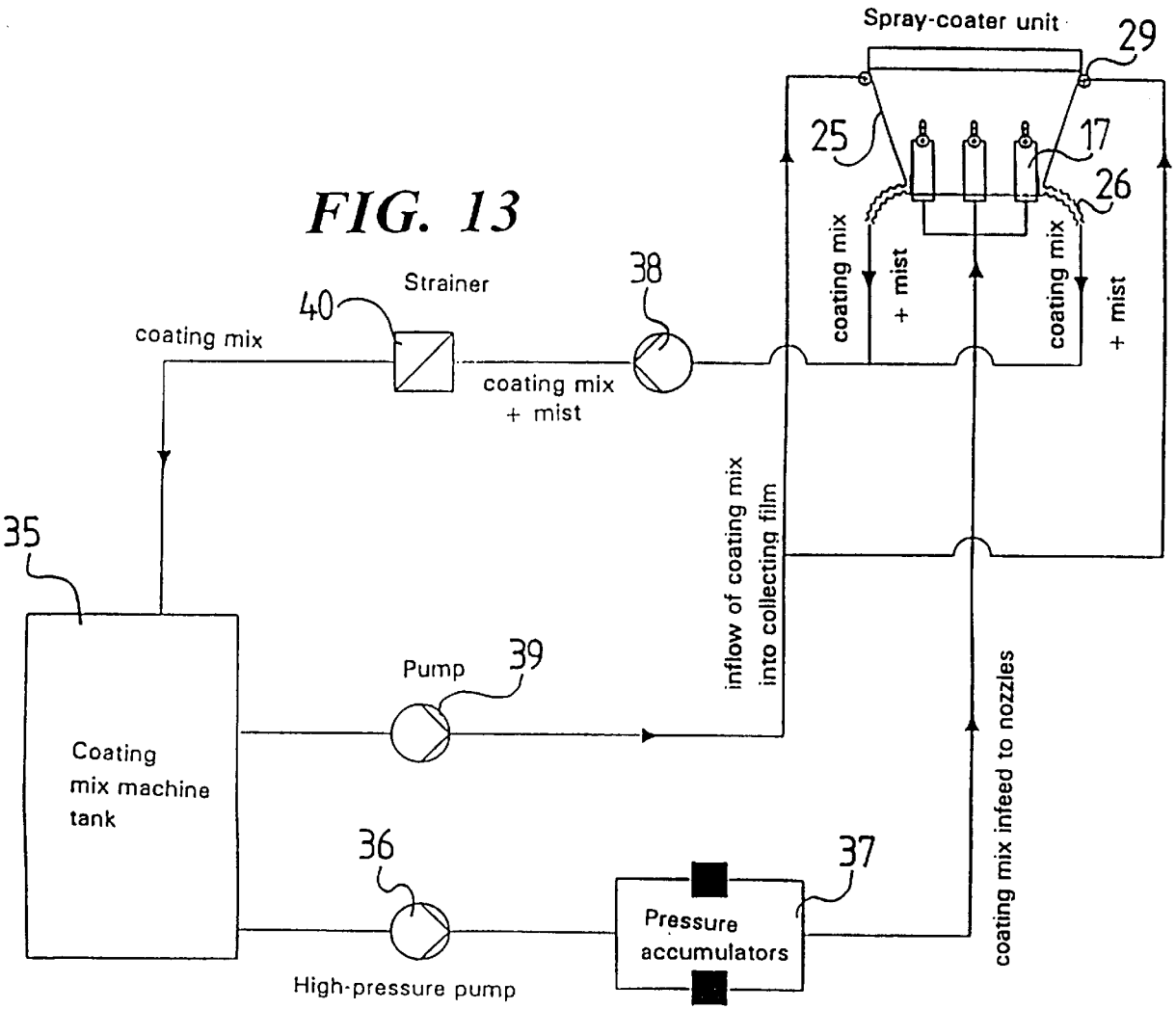
FIG. 13 shows a coating mix circulation system.

In FIG. 13 is shown an embodiment of the coating mix circulation. Therein, the coating mix is pumped from a coating mix machine tank 35 by means of a high-pressure pump 36 via pressure accumulators 37 serving to equalize the feed pressure of the coating mix, and from the pressure accumulators 37, the coating mix is taken to the linear nozzle arrays 17. A separate low-pressure pump 39 is used to feed the coating mix from the machine tank 35 to the coating mix feed tubes 29, and the excess coat mist together with downward-falling flow of coating mix collected from the interior walls is removed from the applicator unit enclosure 25 by means of a pump 38. The removed coating mix with abundant air entrained is taken to a strainer 40, wherein aggregates are filtered away from the coat, which is then returned to the coating mix machine tank.

Figure 14:
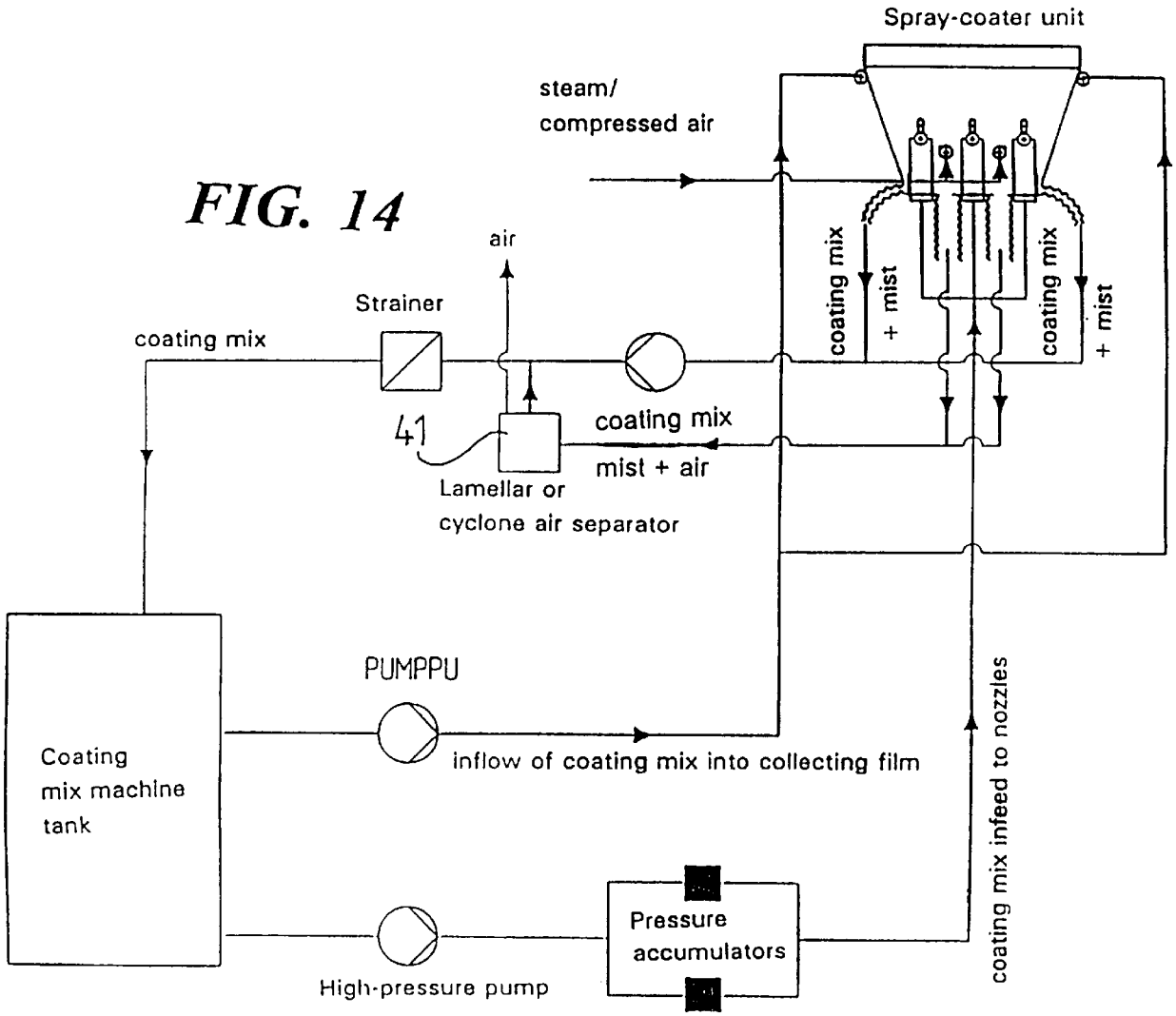
FIG. 14 shows another coating mix circulation system.

In FIG. 14 is shown another coating mix circulation arrangement having an additional lamellar or cyclone separator via which the coat mist with the large volume of entrained air can be passed.

Figure 15:
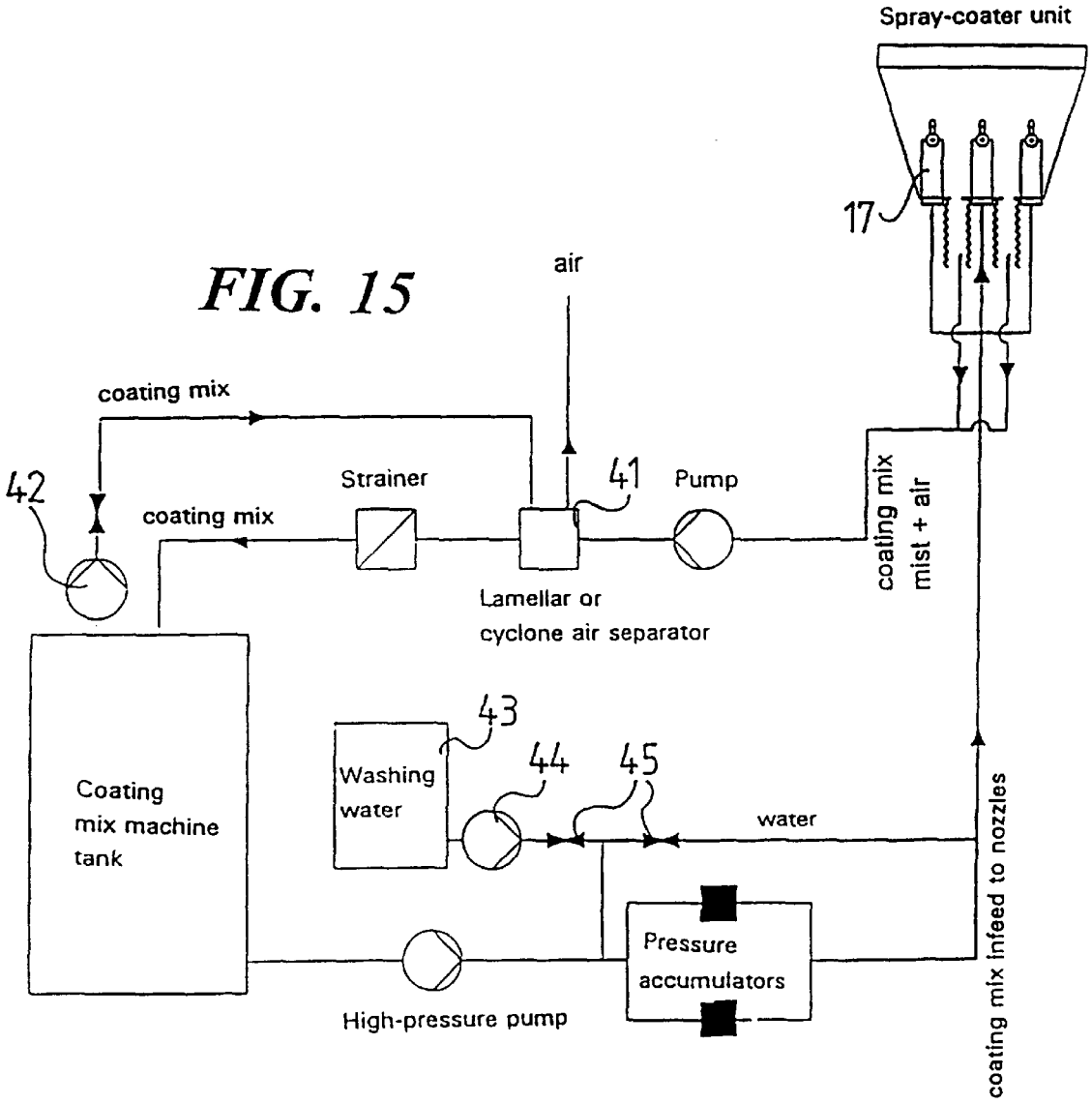
FIG. 15 shows another schematic block diagram of the coating mix circulation system according to the present invention.

In FIG. 15 is shown the most preferred arrangement of coating mix circulation having all of the coating mix, which is removed from the applicator unit, advantageously taken to a lamellar or cyclone separator for separation of entrained air. Typically, the coat returned from the spray-coater contains so much entrained air that efficient air separation is a mandatory step before the coating mix can be recycled back to the coating mix machine tank. In the circulation system illustrated herein, the separator is provided with an additional infeed from the coating mix machine tank 35 to aid the separation of air from the coating mix. The circulation system of FIG. 15 additionally includes a washing line comprising a water tank 43 with a pump 44 and valves 45 for feeding water to the nozzles 17 and the pressure accumulator 37.

The method according to the present invention has been applied in coating tests with results discussed below.

Coating of a full-width web in the tests was generally successful, even to an unexpectedly good degree. Three adjacent spraying zones did not provide a sufficient capacity for attaining high web speeds. The coating capacity was approximately 10 g/m$^2$ at 220 in/mm web speed and approximately 5 g/m$^2$ at 470 m/min. The solids content of the coating mix was 40%. This test did not aim at determining the maximum performance values of the method.

Spray-coating is hampered by strong dusting of the spraying point environment by coating mix particles. The atomized spray of small coating mix droplets can spread everywhere along with air streams unless collected away in a controlled manner. Additionally, the air film travelling with the moving web surface tends to drag along the dust. In the test runs, a blade made from a polymer sheet was used for doctoring the air film away.

The kinetic energy imparted to the sprayed droplets must be sufficiently high, particularly at high web speeds, in order to prevent the moving air film from entraining the coating mix spray even before the spray can impinge on the web surface.

In the test run, the capacity of the nozzles per unit time was measured. When the amount of coating mix adhering to the web is known, also the portion lost in the environment can be calculated. Adjustment of suction fan capacity was found to affect the applied coat weight to a significant degree. The stronger the suction, the less coat could be deposited on the web surface.

The capacity of the nozzles was measured for two different types of nozzles. Nozzle code FF-610 indicates a nozzle with 60° spray angle and 0.010" (0.254 mm) nozzle orifice diameter. The other nozzle tested was with the same spray angle but with 0.012" (0.305 mm) orifice.

The actual tests were performed on the FF-610 nozzle at 160 bar pressure, whereby the nozzle output was 7.5 g/s of wet coating mix. The coating efficiencies (portion of coating mix adhered to the web from the overall amount of sprayed coating mix) at different web speeds are calculated in Table 1.

TABLE 1

| Test point | Av. Coat weight over 1 m unit with of web [g/m$^2$] | Web speed [m/min] | Coating efficiency [%] |
|---|---|---|---|
| 218 | 10.0 | 220 | 87 |
| 221 | 5.0 | 470 | 93 |
| 223 | 7.5 | 280 | 83 |
| 229 | 5.0 | 449 | 89 |

As can be seen, the coating efficiency varied in the range 83–93%. On the average, the loss of sprayed coating mix was 12%.

The webs were measured for cross-machine profiles of base weight, ash and caliper. To speed the measurement, all five profiles were printed sequentially into the same profile plot.

The measurement results shown that the fan-shaped spray pattern of the individual nozzles remains very clearly detectable and the coat weight profile is peaked. Profile deviation from nominal coat weight can be as much as about 6 g /m$^2$ per side. A peak is seen in the coat weight profile at the intersection of the fan edges. Examination of the coat profiles gives a peak-to-peak deviation of 40–60% from the overall coat weight. An interesting observation is, however, that the profile errors are not particularly visible on the finished product, which is indicative of the good opacifying power of the coat. The edge areas of the sprays can be blended smoother by making the spray angle of the nozzles wider, and the greater number of spraying zones required at higher web speeds will finally reduce the fan intersection errors to an insignificant level. Low web speeds necessitate the use of lower-output nozzles to prevent the errors of a single application zone from becoming excessively pronounced. When arranged into a three-row array, the nozzles tested herein are sufficient for applying a coat weight of 10 g/m$^2$ at 220 m/min web speed. To apply the same coat weight at a web speed of 440 m/min, the spray-coater would require a 6-row nozzle assembly, for a web speed of 880 m/min a 12-row assembly and so forth. Then, the profile error caused by a single nozzle will be reduced respectively.

While the coat profiles of a paper passed through a SymSizer size press are peak-free, a certain amount of skew toward the drive side can be seen. A pronounced valley occurs in the coat weight profile very close to the drive-side edge.

Prior to the tests, the greatest doubts were expressed with regard to the surface strength of the sprayed coat. Intuitively, the coat mist was expected to settle in the same fashion as snowflakes on the sheet surface. However, no differences could be found in the coat surface strength in contrast to paper passed through a SymSizer size press. Also the rolls of the supercalender and the printing machine remained free from buildup of coat dirt. Additionally, such a high coat surface strength indicated that the coating mix does not undergo phase separation when exiting the nozzle.

The coated paper was supercalendered to test runnability of spray-coated paper on a full-scale supercalender and to compare its behavior with that of supercalendered paper passed through a Symsizer size press. The spray-coated paper grades were found uncomplicated to run on a calender. The calender rolls remained free from buildup of coat dirt.

The spray-coated paper grades were readily printable. On the basis of samples returned from the printing shop, the following observation could be made:

- spray-coating is a viable application method for coating a web;
- buildup of coat dirt on the rolls of printing machines using spray-coated paper remains insignificant;
- a pronounced difference is seen between the surfaces of transfer-coated and spray-coated paper grades that becomes more accentuated at higher coat weights;
- spray-coating gives a smoother visual appearance, but not as good a printed surface gloss and density as that offered by a transfer-coated paper;
- orange-peel texture is more pronounced on a transfer coated sheet;
- supercalendering of the base sheet clearly improves the surface quality of spray-coated paper.

Overall results of web coating by spraying techniques widely surpassed expectations. Paper surface strength in calendering and printing is imperative prerequisite for further development of the method. At least on the basis of tests performed, sufficient strength of coat surface seems to be attainable.

As compared visually to a comparative sample passed through a SymSizer size press, the paper surface and printing quality seemed smooth, even promising. Under visual examination, the print gloss and density of spray-coated paper did not reach the quality level of the comparative sample.

The paper surface appears well-opacified and no sign of "cracker bread" effect (that is, splashing of coat as large droplets on the sheet surface) was present. Obviously, due to the fully conformant deposition of the coat layer applied by the spraying technique, the method has some special characteristics and thus sets certain requirements for the coating process. Accordingly, the base sheet should have a maximally smooth surface.

The operating life of nozzles could not be evaluated within the time span of tests performed. Experiences from similar nozzles used in painting technology indicate that the nozzle life will be rather limited, because abrasive wear of the nozzle causes progressive narrowing of the spray angle and widening of the nozzle orifice, whereby both the surface quality and coat profile will suffer. Therefore, the service life of nozzles in the spraying of coating mixes need to be assessed in detail.

Thus, while there have been shown and described and pointed out fundamental novel features of the present invention as applied to preferred embodiments thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A method of coating a moving web of paper or paperboard with a coating mix, comprising:

applying a layer of a coating mix to a surface of a moving web of paper or paperboard by spraying an atomized mist of the coating mix onto the surface of the web by means of a plurality of substantially airless high pressure spraying nozzles positioned across a width of the web, a diameter of a spray pattern of each spraying nozzle at a point where spray from the nozzle contacts the surface of the web being less than the width of the web.

2. The method of claim 1, wherein the layer of coating mix is applied by means of at least three arrays of the nozzles aligned across the width of the web.

3. The method of claim 1, further comprising controlling a coating profile across the width of the web of coating mix applied by the nozzles by closing and opening the nozzles.

4. The method of claim 1, further comprising controlling an amount of coating mix applied to the web by the nozzles by closing and opening the nozzles.

5. The method of claim 1, wherein the coating mix supplied to the spraying nozzles is supplied at a pressure of from 1 MPa to 200 MPa.

6. The method of claim 5, wherein the coating mix supplied to the spraying nozzles is supplied at a pressure of from 1 MPa to 2 MPa.

7. The method of claim 1, wherein a distance between the spraying nozzles and the web is from 10 mm to 500 mm.

8. The method of claim 7, wherein a distance between the spraying nozzles and the web is from 80 mm to 150 mm.

9. The method of claim 1, wherein a distance between adjacent spraying nozzles is from 5 mm to 500 mm.

10. The method of claim 9, wherein a distance between adjacent spraying nozzles is from 30 mm to 200 mm.

11. The method of claim 1, further comprising supporting an opposite surface of the web opposite to the surface to which a layer of coating is being applied.

12. The method of claim 11, wherein the opposite surface of the web is supported by a belt.

13. An apparatus for coating a moving web of paper or paperboard with a coating mix, comprising:

a support means for supporting a surface of a moving web or paper or paperboard; and a coating applicator unit comprising:

a plurality of substantially airless high pressure spraying nozzles positioned across a width of the web, a diameter of a spray pattern of each spraying nozzle at a point where an atomized spray from the nozzle contacts an unsupported surface of the web being less than the width of the web; and an enclosure sized, shaped and positioned to enclose said plurality of said nozzles against the unsupported surface of the web.

14. The apparatus of claim 13, wherein said plurality of said nozzles comprises at least three lines of said nozzles in which the nozzles of each line of nozzles are staggered with respect to the nozzles of an adjacent line of nozzles.

15. The apparatus of claim 13, wherein said support means is a backing roll.

16. The apparatus of claim 15, further comprising at least three of said coating applicator units.

17. The apparatus of claim 13, wherein said support means is a belt.

18. The apparatus of claim 17, further comprising at least two of said coating applicator units.

19. The apparatus of claim 13, further comprising an air-injection means for ejecting a jet of air, said air-injection means having a slot orifice opening positioned to eject the jet of air toward the surface of the web to be coated and in a direction opposite to the direction of travel of the web.

20. The apparatus of claim 13, further comprising an air knife positioned on a side of said enclosure to remove an air film from a surface of the web to be coated before said web surface enters said coating applicator unit.

21. The apparatus of claim 13, further comprising a coating mix feeding means for feeding coating mix to an inner surface of said enclosure to collect coating mix accumulating on the inner surface of said enclosure.

* * * * *